US011006816B2

(12) United States Patent
Miwa

(10) Patent No.: US 11,006,816 B2
(45) Date of Patent: May 18, 2021

(54) CLEANING TOOL

(71) Applicant: KABUSHIKI KAISHA NITOMS, Tokyo (JP)

(72) Inventor: Masami Miwa, Tokyo (JP)

(73) Assignee: KABUSHIKI KAISHA NITOMS, Tokyo (JP)

( * ) Notice: Subject to any disclaimer, the term of this patent is extended or adjusted under 35 U.S.C. 154(b) by 358 days.

(21) Appl. No.: 16/303,770

(22) PCT Filed: Jun. 17, 2016

(86) PCT No.: PCT/JP2016/068081

§ 371 (c)(1),
(2) Date: Nov. 21, 2018

(87) PCT Pub. No.: WO2017/216949

PCT Pub. Date: Dec. 21, 2017

(65) Prior Publication Data

US 2020/0170482 A1 Jun. 4, 2020

(51) Int. Cl.
*A47L 25/00* (2006.01)

(52) U.S. Cl.
CPC ..... *A47L 25/005* (2013.01)

(58) Field of Classification Search
CPC ..... A47L 25/005
See application file for complete search history.

(56) References Cited

U.S. PATENT DOCUMENTS 5,533,223 A * 7/1996 Ho ..... A47L 25/005 15/104.02
2012/0284939 A1* 11/2012 Anderson ..... A47L 25/005 15/104.002
2016/0120392 A1* 5/2016 Jang ..... A47L 25/08 15/104.002

FOREIGN PATENT DOCUMENTS

| | | | |
|---|---|---|---|
| JP | H05-053916 | U | 7/1993 |
| JP | H06-085660 | U | 12/1994 |
| JP | 2003-052602 | A | 2/2003 |
| JP | 2003-265401 | A | 9/2003 |
| JP | 2004-041415 | A | 2/2004 |
| JP | 2004-057602 | A | 2/2004 |
| JP | 2004-073562 | A | 3/2004 |
| JP | 2004-243000 | A | 9/2004 |
| JP | 2006-288605 | A | 10/2006 |

OTHER PUBLICATIONS

PCT/ISA/210, "International Search Report for International Application No. PCT/JP2016/068081," dated Sep. 6, 2016.

* cited by examiner

*Primary Examiner* — Randall E Chin
(74) *Attorney, Agent, or Firm* — Manabu Kanesaka

(57) ABSTRACT

A cleaning tool includes a support tool for rotatably supporting an adhesive tape roll via bearing members; and a storing case for storing the adhesive tape roll. Bearing caps detachably attached to both ends of the adhesive tape roll are used as the bearing members. The support tool has a gate-shaped frame which is made of a synthetic resin and includes a pair of left and right leg plates and a support base extending between the upper ends of the leg plates. An opening having substantially the same width as the gate-shaped frame while the storing case is closed, is formed between matching surfaces of a pair of openable case members from both side surfaces thereof over an upper surface thereof, the case members constituting the storing case. A portion of the outer contour of the storing case is complemented by the gate-shaped frame of the support tool.

6 Claims, 7 Drawing Sheets

CLEANING TOOL

RELATED APPLICATIONS

The present application is National Phase of International Application No. PCT/JP2016/068081 filed Jun. 17, 2016, the disclosure of which is hereby incorporated by reference herein in its entirety.

TECHNICAL FIELD

The present invention relates to a cleaning tool using an adhesive tape roll, and more specifically, to a support tool of the adhesive tape roll and a storing case for storing the adhesive tape roll when not in use.

BACKGROUND ART

The adhesive tape roll is an adhesive cleaning roll constituted by winding a tape base material having an adhesive member layer on one surface a predetermined number of times so that the adhesive member layer thereof is placed outside and is rolled over a surface to be cleaned such as a floor surface to catch garbage with the adhesive member layer. The adhesive tape roll is provided with a perforation line approximately at every circumference, and stripping off the adhesive tape at the outermost periphery, an adhesive force of which is weakened by catches of garbage, causes an unused adhesive tape in an underlayer to newly appear.

Since the adhesive member layer is always exposed on the surface, the cleaning tool requires a dedicated support tool (operation tool) for rolling the adhesive tape roll and a storing case for storing the adhesive tape roll when not in use.

Various types of support tools are available, and an invention disclosed in Patent Literature 1 uses a support tool including a cylindrical support roller which is inserted into a winding core of an adhesive tape roll and a support shaft including a spindle part for pivotally supporting the support roller at one end thereof and a grip part (operation handle) at the other end.

A storing case constructed of a pair of half-split-shaped case members, a base part of which is connected to be openable by a hinge part and a whole of which is formed of injection molded synthetic resin is used as the storing case for storing the adhesive tape roll.

In the above-described support tool, a metal shaft which is folded into a cantilever hanger shape is used as the support shaft, which, however, is more expensive than a resin shaft.

The winding core of the adhesive tape roll has an inner diameter larger than the diameter of the spindle part of the support shaft, and so the support roller having substantially the same diameter as the inner diameter of the winding core is attached to the spindle part to rotatably support the adhesive tape roll via the support roller, but the use of the support roller constitutes a factor of a cost increase.

Furthermore, the adhesive tape roll is attached to the support tool and stored in the storing case, but the adhesive tape roll needs to be held in midair in the storing case to prevent the adhesive surface of the adhesive tape from adhering to an inner surface of the storing case.

As a way to achieve this object, the invention disclosed in Patent Literature 1 provides an engaging part for sandwiching part of the support shaft when the case is closed at a position close to the center of gravity of the grip on a matching surface of the pair of half-split-shaped case members, which, however, requires a complicated molding die and is not preferable in terms of cost.

Another method for preventing the adhesive tape roll from sticking to the inner surface of the storing case is forming a plurality of ribs arranged in a circumferential direction of the adhesive tape roll on the inner surface of the storing case along the axial direction of the adhesive tape roll as disclosed in Patent Literature 2. However, setting up the ribs over a relatively large area along the circumferential direction of the adhesive tape roll on the inner surface of the storing case results in a problem that sinks are more likely to occur during injection molding.

CITATION LIST

Patent Literature

Patent Literature 1: Japanese Patent Application Laid-Open No. 2003-265401

Patent Literature 2: Japanese Patent Application Laid-Open No. 2004-73562

SUMMARY OF INVENTION

Technical Problem

It is therefore an object of the present invention to provide a cleaning tool including a support tool, a whole of which is made of synthetic resin, the cleaning tool designed to have a harmonious combination of the support tool and a storing case.

Solution to Problem

In order to solve the above-described problems, the present invention provides a cleaning tool including an adhesive tape roll constituted by winding a tape base material including an adhesive member layer on one surface around a winding core a predetermined number of times so that the adhesive member layer is placed outside, a support tool including an operation handle and rotatably supporting the adhesive tape roll via bearing members, and a storing case made of synthetic resin in which the adhesive tape roll is stored while being supported by the support tool, in which a pair of left and right bearing caps detachably engaged to both ends of the winding core are used as the bearing members, each of the bearing caps is made of synthetic resin and a rotary spindle is coaxially disposed on each cap, the support tool includes a gate-shaped frame made of synthetic resin including a pair of left and right leg plates having bearing holes that engage with the rotary spindles and a support base extending between upper ends of the leg plates, each of the leg plates and the support base having substantially the same width, and the storing case includes a pair of half-split-shaped case members, bases of which are openably coupled by a hinge part, an opening having substantially the same width as the gate-shaped frame when the storing case is closed is formed between matching surfaces from both side surfaces of the case members to upper surfaces thereof, and a portion of the outer contour of the storing case is complemented by the gate-shaped frame.

According to the present invention, engagement pieces are formed in substantially a center on an upper surface side of the respective case members in directions facing each other, and engagement grooves are formed on both side surfaces of the support base as counterparts of the engagement pieces.

According to the present invention, leg parts are provided which extend behind rear edges of the engagement pieces and are formed integrally with an inner wall surface of the case members on both right and left ends of the engagement pieces and a gap for preventing sinks during injection molding is formed between the rear edge of the engagement piece and the inner wall surface of the case member.

According to the present invention, the bearing cap includes a cap cover having a larger diameter than the inner diameter of the winding core and including the rotary spindle in a center thereof and a skirt part integrally provided on the back side of the cap cover so as to be inserted into the winding core, and a finger hook hole is formed in the cap cover.

The cap cover is preferably formed into a mountain shape in which a peripheral edge thereof corresponds to a hem and a central part thereof at which the rotary spindle is provided corresponds to an apex.

According to the present invention, a portion of each leg piece from the bearing hole to the end portion is formed as a finger hook part which is inclined in a direction gradually away from the bearing cap.

Advantageous Effects of Invention

According to the present invention, bearing caps made of synthetic resin are attached to both ends of an adhesive tape roll as bearing members, an support tool of the adhesive tape roll is constructed of a gate-shaped frame made of synthetic resin including a pair of left and right leg plates having bearing holes that engage with a rotary spindles of the bearing caps and a support base extending between upper ends of the leg plates, each of the leg plates and the support base having substantially the same width, thus eliminating the necessity for any metal shaft and support roller, and it is thereby possible to reduce the cost accordingly. Furthermore, an opening having substantially the same width as the gate-shaped frame of the support tool while the storing case is closed is formed between matching surfaces from both side surfaces of the case member constituting the storing case to upper surfaces thereof, and a portion of the outer contour of the storing case is complemented by the gate-shaped frame, and it is thereby possible to provide a cleaning tool designed to have a harmonious combination of a support tool and a storing case.

DESCRIPTION OF EMBODIMENTS

Next, an embodiment of the present invention will be described with reference to FIG. 1 to FIG. 7, but the present invention is not limited to this.

Figure 1:
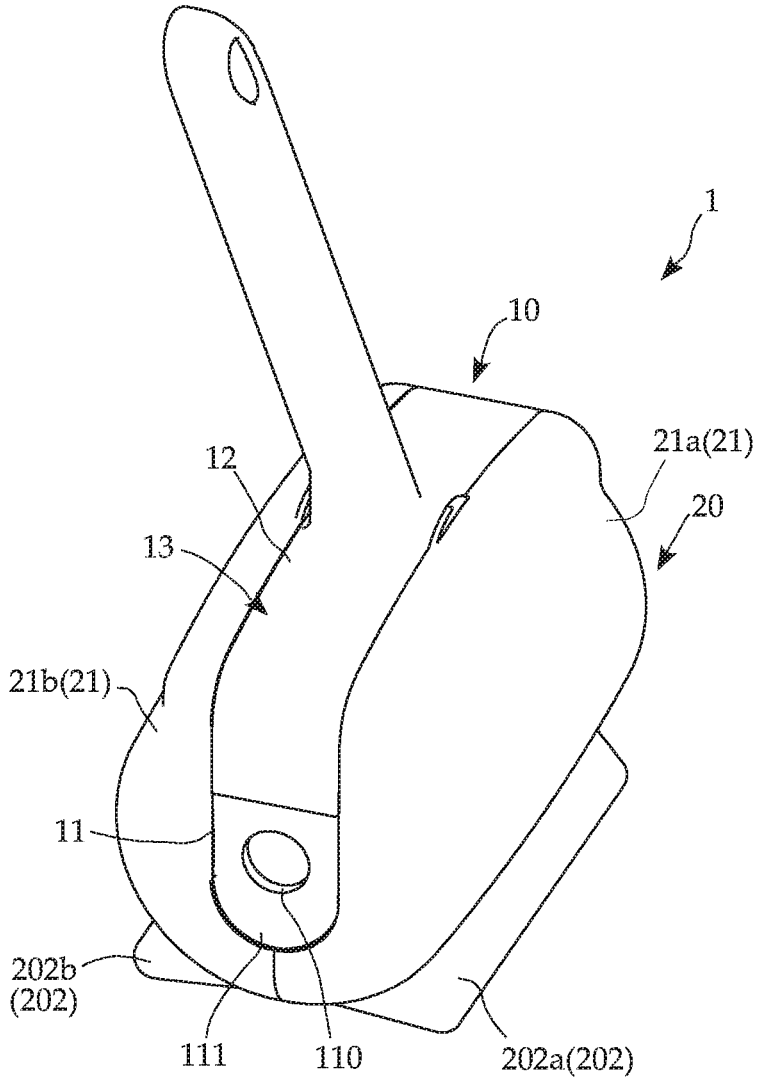
FIG. 1 is a perspective view illustrating a cleaning tool according to an embodiment of the present invention.
Figure 2:
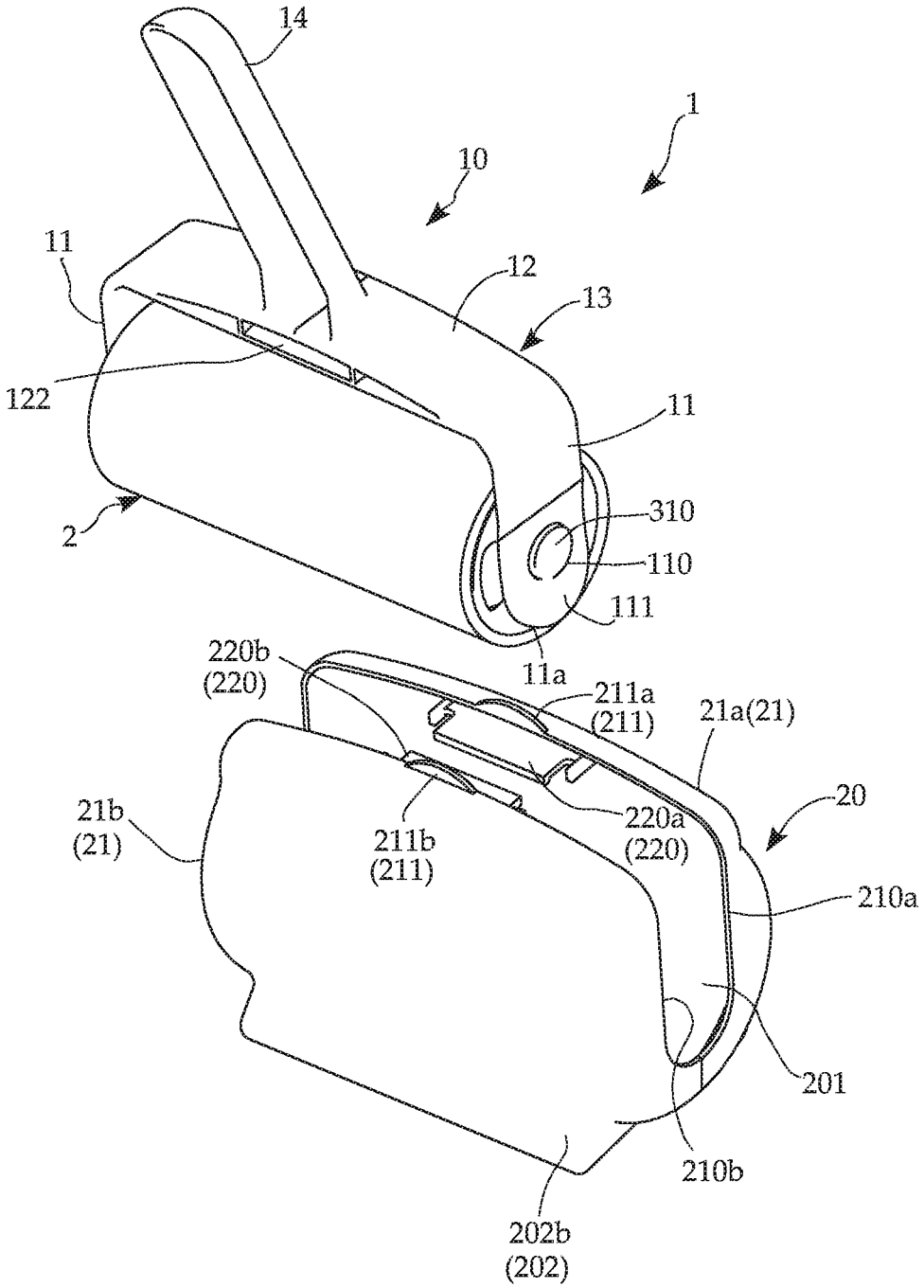
FIG. 2 is a perspective view separately illustrating a support tool and a storing case included in the cleaning tool.

First, referring to FIG. 1 and FIG. 2, a cleaning tool 1 according to the present embodiment includes a support tool 10 for rotatably supporting an adhesive tape roll 2 and a storing case 20 for storing the adhesive tape roll 2 when not in use in a state in which the adhesive tape roll 2 is supported by support tool 10.

Although not illustrated more specifically, the adhesive tape roll 2 is constituted by winding a tape base material having an adhesive member layer on one surface around a winding core 2*a* (see FIG. 5) a predetermined number of times so that the adhesive member layer is placed outside and is provided with a perforation line approximately at every circumference.

Figure 3A:
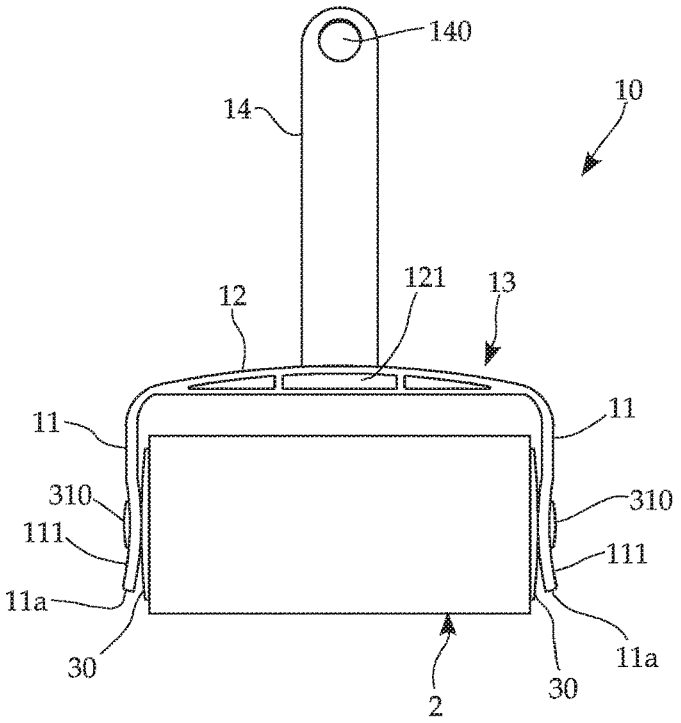
FIG. 3(*a*) is a front view and FIG. 3(*b*) is a perspective view, illustrating the support tool supporting an adhesive tape roll.
Figure 3B:
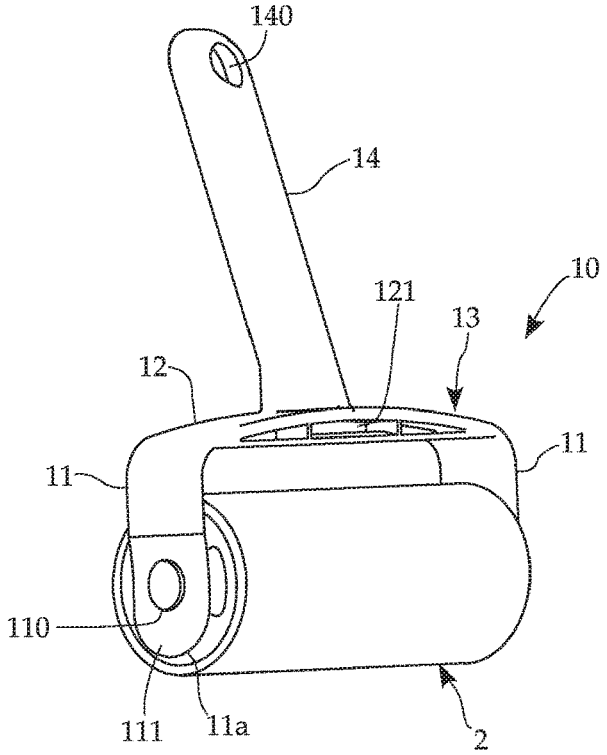

Referring to FIG. 3 together, the support tool 10 includes a gate-shaped frame 13 including a pair of left and right leg plates 11, 11 and a support base 12 extending between upper ends of the leg plates 11, 11. The leg plate 11 on the right side and the leg plate 11 on the left side are arranged so as to face each other at a distance substantially equal to an axial length of the adhesive tape roll 2.

The gate-shaped frame 13 has substantially the same width over the right side leg plate 11, the support base 12 and the left side leg plate 11 and a grip part (operation handle) 14 is erected at substantially the center of the support base 12 in the present embodiment. The whole gate-shaped frame 13 including the grip part 14 is made of a synthetic resin member. Note that the grip part 14 may also be drawn laterally from a shoulder of one leg plate 11.

According to the present embodiment, bearing caps 30, 30 are attached to both ends of the adhesive tape roll 2 as bearing members in order to rotatably support the adhesive tape roll 2 to the support tool 10. The bearing caps 30, 30 have the same configuration and are preferably made of a synthetic resin member.

Figure 4A:
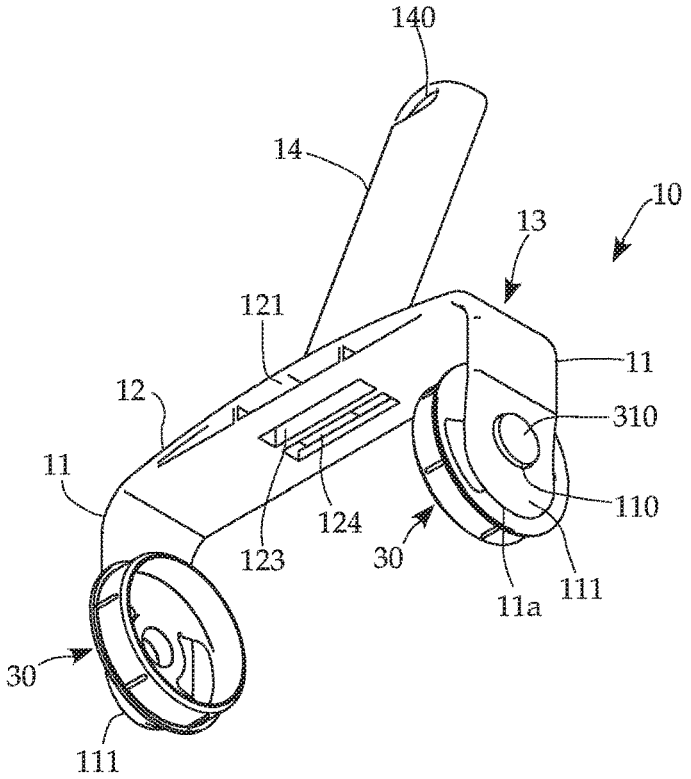
FIG. 4(*a*) is a front side perspective view and FIG. 4(*b*) is a rear side perspective view, viewing the support tool with bearing caps attached from a bottom surface direction.
Figure 4B:
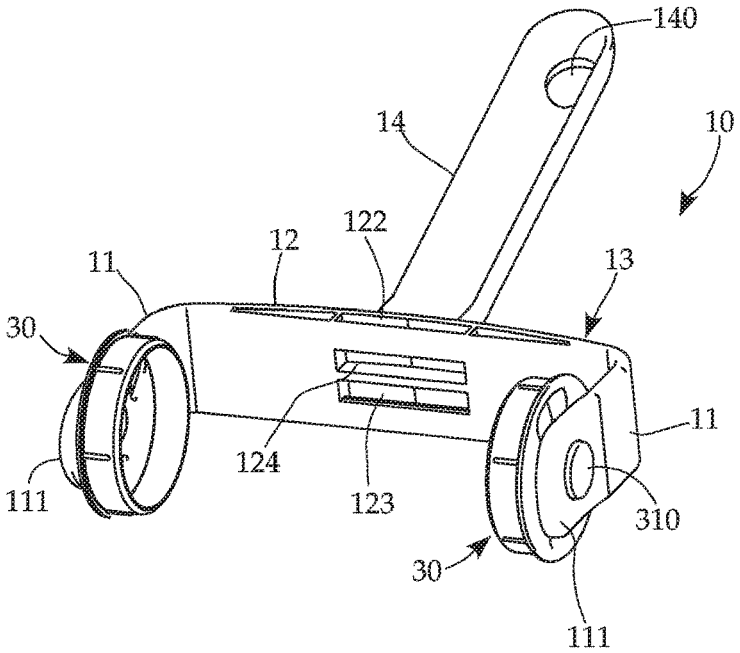
Figure 5:
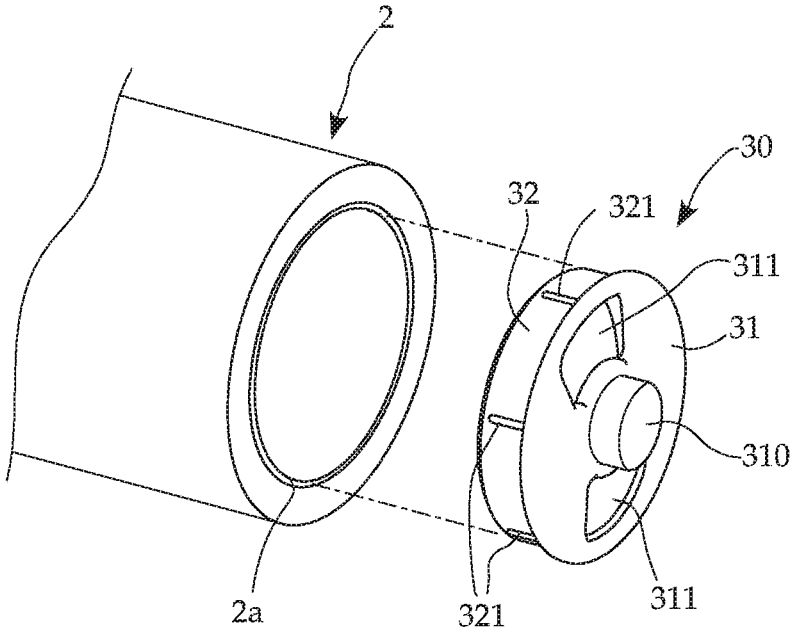
FIG. 5 is a perspective view illustrating a state in which the bearing cap is attached to an end portion of the adhesive tape roll.

Referring to FIG. 4 and FIG. 5, the bearing cap 30 is provided with a cap cover 31 and a skirt part 32. The cap cover 31 has a larger diameter than an inner diameter of the winding core 2*a* and is provided with a rotary spindle 310 at a center thereof. The skirt part 32 has a cylindrical shape and is provided coaxially and integrally with a back side of the cap cover 31 so as to go into the winding core 2*a*.

A plurality of ribs 321 are preferably formed on an outer circumferential side of the skirt part 32 so as to engage with the inner surface of the winding core 2*a* with an appropriate frictional force. A finger hook hole 311 is formed in the cap cover 31 to facilitate the holding by fingers when attaching or removing the cap cover 31 to/from the adhesive tape roll 2.

The leg plates 11, 11 are each provided with a bearing hole 110 that engages with the rotary spindle 310 of the bearing cap 30. Note that although FIG. 4 illustrates a state in which the bearing caps 30 are attached to the respective leg plates 11, the bearing caps 30, 30 are actually attached to both ends of the adhesive tape roll 2 first, and then the bearing holes 110, 110 of the leg plates 11, 11 engage with the rotary spindles 310, 310.

The adhesive tape roll 2 is removed by hooking a finger onto the end portions 11*a*, 11*a* of the leg plates 11, 11 and widening the interval between the leg plates 11, 11 so that the bearing holes 110, 110 come off from the rotary spindles 310, 310, and a portion from the bearing hole 110 of each leg piece 11 to the end portion 11*a* is formed as a finger hook part 111 which is inclined in a direction gradually away from the bearing cap 30.

The cap cover 31 of the bearing cap 30 preferably has a mountain shape in which the peripheral edge corresponds to a hem and the central part provided with the rotary spindle 310 corresponds to an apex as shown in FIG. 3(*a*) in order to reduce a contact area with the leg plates 11 in the vicinity of the rotary spindle 310 and make rotation of the adhesive tape roll 2 smoother. This mountain shape may include not only a convex spherical surface (cup shape) but also a conical surface such as a triangular pyramid or quadrangular pyramid.

Figure 6:
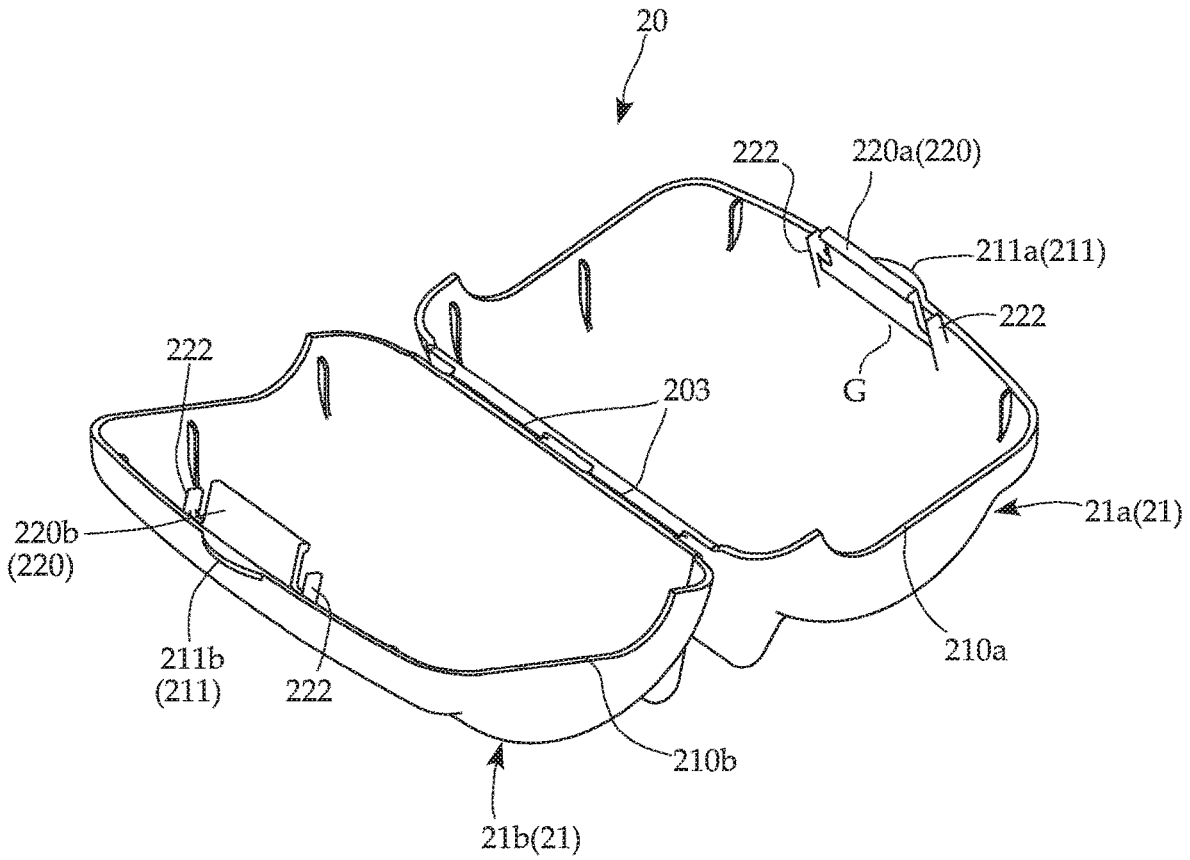
FIG. 6 is a perspective view of the storing case when opened.

Referring to FIG. 2 and FIG. 6 together, the storing case 20 is provided with a pair of left and right case members 21*a* and 21*b* which are half-split-shaped, constituted by dividing a cylindrical body having both end walls into two portions along an axial line thereof, base parts of which are openably coupled by hinge parts 203 and a whole of which is made of synthetic resin. In the present embodiment, the hinge part 203 is a thin-film hinge but may also be a hinge structure.

Leg parts 202*a* and 202*b* which become a stable leg 202 when closed for causing the storing case 20 to stand alone are formed on the respective base parts of the case members 21*a* and 21*b* as shown in FIG. 1. Note that when the case members 21*a* and 21*b* need not be distinguished, a generic term "case member 21" may be used.

An opening 201 is formed between matching surfaces 210*a* and 210*b* from both side surfaces of the case members 21*a* and 21*b* to the upper surfaces thereof, the opening 201 having a width substantially equal to the width of the gate-shaped frame 13 when the storing case 20 is closed.

Accordingly, when the adhesive tape roll 2 is stored in the storing case 20 while it is being supported by the support tool 10, a portion of the outer contour of the storing case 20 is complemented by the gate-shaped frame 13 as shown in FIG. 1.

Locking claws 211 (211*a*, 211*b*) are uprightly stood at substantially the center on the upper surface side of the case members 21*a* and 21*b* so as to stand from the top end edges. The locking claws 211 function as finger hook parts when the storing case 20 is opened.

Furthermore, engagement pieces 220*a* and 220*b* are formed so as to face each other in the opening 201 in substantially the center on the upper surface side of the case members 21*a* and 21*b*. When the engagement pieces 220*a* and 220*b* need not be distinguished, a generic term "engagement piece 220" may be used.

Figure 7A:
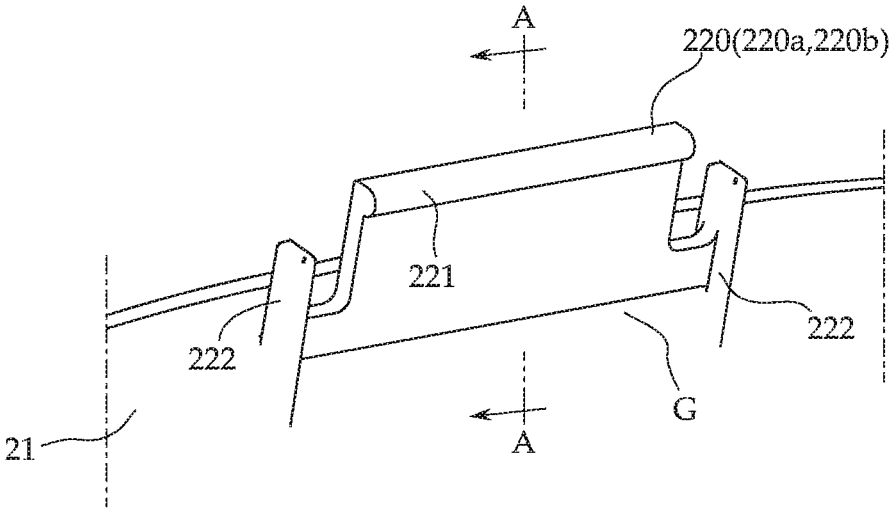
FIG. 7(*a*) is an enlarged perspective view and FIG. 7(*b*) is a cross-sectional view along a line A-A of an engagement piece provided in the storing case.
Figure 7B:
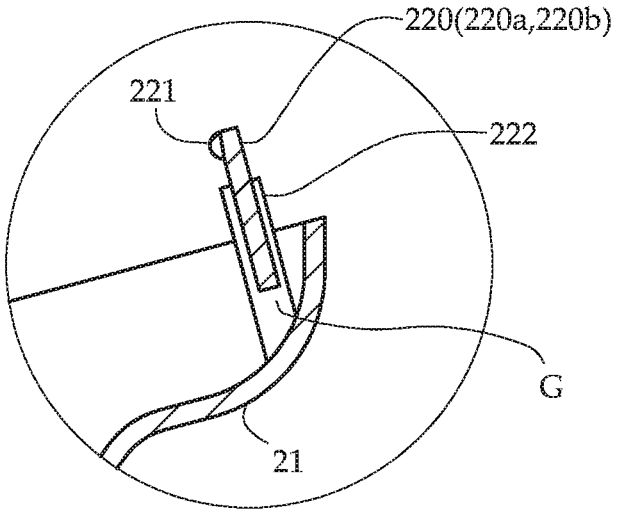

Referring to FIGS. 7(*a*) and 7(*b*) together, support stays 222, 222 as a left and right pair are integrally formed on both side surfaces of the engagement piece 220, and the engagement piece 220 is supported by these support stays 222, 222 so that a predetermined gap G is produced between the rear end thereof and the inner wall of the case member 21, that is, the engagement piece 220 is supported so as to float from the inner wall of the case member 21.

The engagement piece 220 including the portions of the support stays 222 is injection molded in a metal die (not shown) together with the case member 21, but since the engagement piece 220 is floating from the inner wall of the case member 21, it is possible to minimize sinks during molding.

Referring to FIGS. 4(*a*) and 4(*b*) together again, an engagement groove 121 into which one engagement piece 220*a* is inserted is formed on the front side of the support base 12 of the support tool 10 and an engagement groove 122 into which the other engagement piece 220*b* is inserted is formed on the rear side of the support base 12.

A hook part 221 is formed at a distal end of the engagement piece 220 as shown in FIG. 7. In correspondence with this, engagement holes 123 and 124 are punched at deep positions of the engagement grooves 121 and 122 with which the hook part 221 engages while preferably generating click sound.

The adhesive tape roll 2 is used while being rotatably supported by the support tool 10 to clean a floor surface, placed while being supported by the support tool 10 in the storing case 20 which is open as shown in FIG. 6 after cleaning and stored in the storing case 20 by closing the case members 21*a* and 21*b*.

When the case members 21*a* and 21*b* are closed, the engagement pieces 220*a* and 220*b* are inserted into the engagement grooves 121 and 122 of the support base 12, and further the hook parts 221 engage with the engagement holes 123 and 124, the gate-shaped frame 13 of the support tool 12 thereby apparently becomes a portion of the storing case 20 and the storing case 20 is closed.

According to the cleaning tool 1, when the adhesive tape roll 2 is rotatably supported by the support tool 10, the bearing caps 30 made of synthetic resin need only to be attached to both ends of the adhesive tape roll 2 as bearing members, and since this eliminates the necessity for any support roller to be inserted into the winding core of the adhesive tape roll 2, it is possible to achieve a cost reduction.

The cost can also be reduced by constructing the support tool 10 of the gate-shaped frame 13 made of synthetic resin including the pair of left and right leg plates 11 having the bearing holes 110 that engage with the rotary spindles 310 of the bearing caps 30 and the support base 12 extending between upper ends of the leg plates 11, each of the leg plates 11 and the support base 12 having substantially the same width, and thereby excluding any metal shaft.

Furthermore, the opening 201 having substantially the same width as that of the gate-shaped frame 13 of the support tool 10 when the storing case 20 is closed is formed between the matching surfaces 210*a* and 210*b* from both side surfaces of the case members 21 constituting the storing case 20 to the upper surfaces thereof, and a portion of the outer contour of the storing case 20 is complemented by the gate-shaped frame 13, and it is thereby possible to obtain a cleaning tool designed to have a harmonious combination of the support tool 10 and the storing case 20.

The invention claimed is:

1. A cleaning tool comprising:

an adhesive tape roll constituted by winding a tape base material comprising an adhesive member layer on one surface around a winding core a predetermined number of times such that the adhesive member layer is placed outside;

a support tool comprising an operation handle and rotatably supporting the adhesive tape roll via bearing members; and a storing case made of synthetic resin in which the adhesive tape roll is stored while being supported by the support tool, wherein a pair of left and right bearing caps detachably engaged to both ends of the winding core are used as the bearing members, each of the bearing caps is made of synthetic resin and a rotary spindle is coaxially disposed on each cap, the support tool comprises a gate-shaped frame made of synthetic resin including a pair of left and right leg plates having bearing holes that engage with the rotary spindles and a support base extending between upper ends of the leg plates, each of the leg plates and the support base having substantially a same width, and the storing case comprises a pair of half-split-shaped case members, bases of which are openably coupled by a hinge part, an opening having substantially the same width as the gate-shaped frame when the storing case is closed is formed between matching surfaces from both side surfaces of the case members to upper surfaces thereof, and a portion of an outer contour of the storing case is complemented by the gate-shaped frame.

2. The cleaning tool according to claim 1, further comprising engagement pieces formed in substantially a center on an upper surface side of the respective case members in directions facing each other, wherein engagement grooves are formed on both side surfaces of the support base as counterparts of the engagement pieces.

3. The cleaning tool according to claim 2, further comprising leg parts extending behind rear edges of the engagement pieces and formed integrally with an inner wall surface of the case members on both right and left ends of the engagement pieces, wherein a gap for preventing sinks during injection molding is formed between the rear edge of the engagement piece and the inner wall surface of the case member.

4. The cleaning tool according to claim 1, wherein the bearing cap comprises a cap cover having a larger diameter than the inner diameter of the winding core and including the rotary spindle in a center thereof and a skirt part integrally provided on a back side of the cap cover so as to be inserted into the winding core, and a finger hook hole is formed in the cap cover.

5. The cleaning tool according to claim 4, wherein the cap cover is formed into a mountain shape in which a peripheral edge thereof corresponds to a hem and a central part thereof at which the rotary spindle is provided corresponds to an apex.

6. The cleaning tool according to claim 1, wherein a portion of each of the leg plates from the bearing hole to an end portion is formed as a finger hook part which is inclined in a direction gradually away from the bearing cap.

* * * * *